US005574236A

United States Patent [19]

Webber

[11] Patent Number: 5,574,236

[45] Date of Patent: Nov. 12, 1996

[54] DRUM MUFFLING AND MICROPHONE SUSPENSION ASSEMBLY

[76] Inventor: Steven R. Webber, 9708 Overbrook Rd., Leawood, Kans. 66206

[21] Appl. No.: 240,172

[22] Filed: May 9, 1994

[51] Int. Cl.[6] ..... G10D 13/02

[52] U.S. Cl. ..... 84/411 M

[58] Field of Search ..... 181/171, 158; 381/169; 84/411 R, 411 M

[56] References Cited

U.S. PATENT DOCUMENTS

| | | | |
|---|---|---|---|
| 2,499,616 | 3/1950 | Walberg | 84/411 R |
| 2,572,504 | 10/1951 | Meriwether | 84/411 R |
| 3,653,625 | 4/1972 | Plice | 381/169 X |
| 4,168,646 | 9/1979 | May | 84/411 R |
| 4,589,323 | 5/1986 | Belli et al. | 84/411 R |
| 4,791,674 | 12/1988 | Drever | 381/169 |
| 5,042,356 | 8/1991 | Karch | 84/411 R |

*Primary Examiner*—Khanh Dang

*Attorney, Agent, or Firm*—Homer L. Knearl; Lee R. Osman; Holland & Hart LLP

[57] ABSTRACT

Contained herein are the details of a new drum muffling system for muffling harmonics and overtones of any commercially available drum. The assembly also has the ability to suspend a microphone in proper placement as required by so many modern recording and amplification techniques. The assembly allows for zero interference in the proper seating of the skin on the shell of the drum. The assembly rests against the skin of the drum, and no holes need be drilled in the shell and no part of the system touches the skin of the drum except the actual muffler. The tension against the skin is fully adjustable to muffle overtones of as each application requires.

4 Claims, 5 Drawing Sheets

Fig. 1A
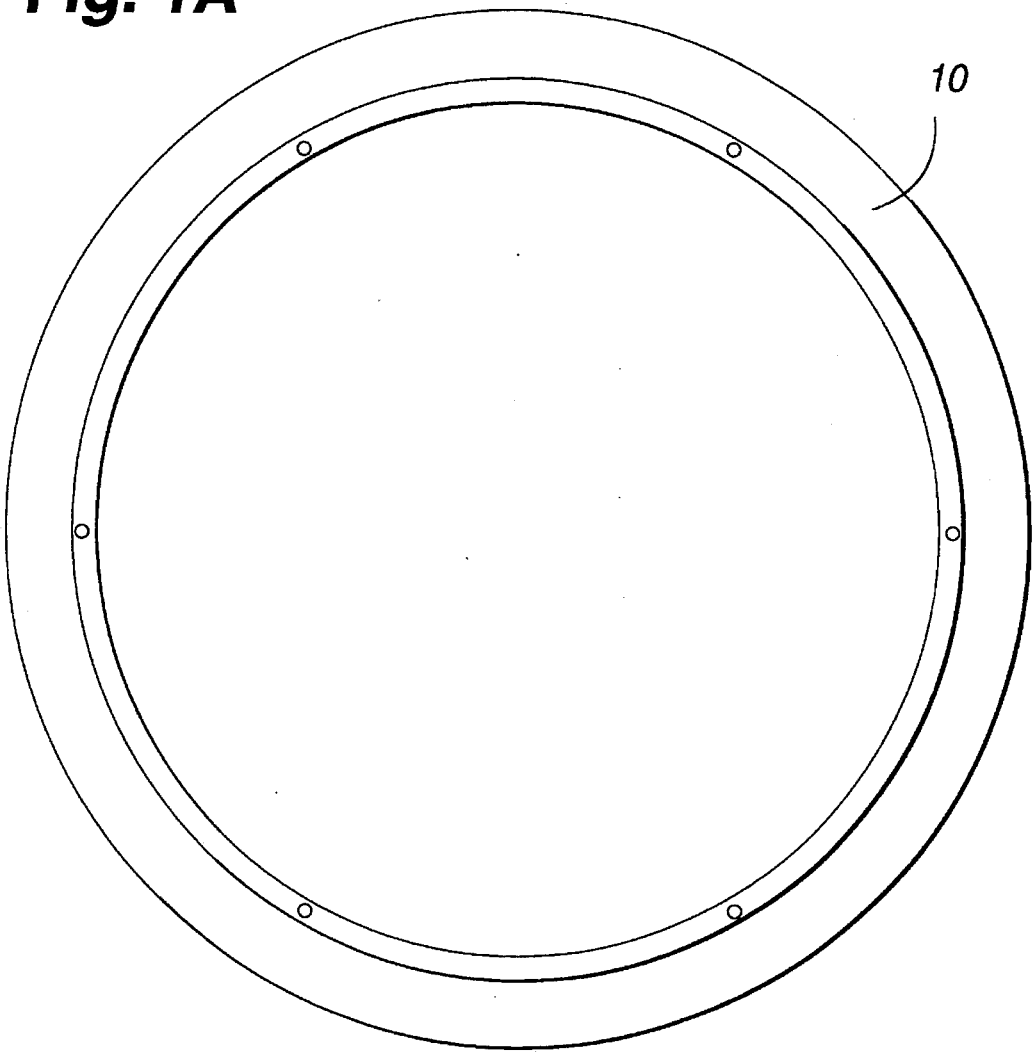
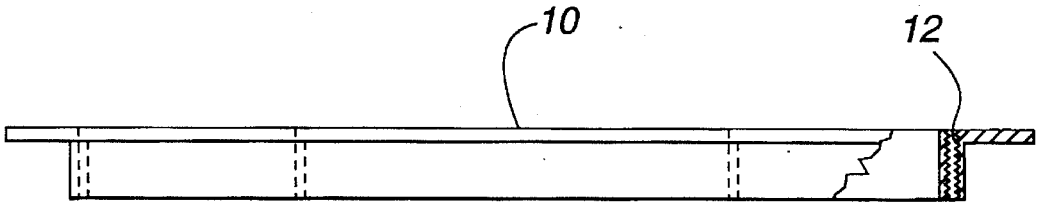
Fig. 1B

Fig. 3A
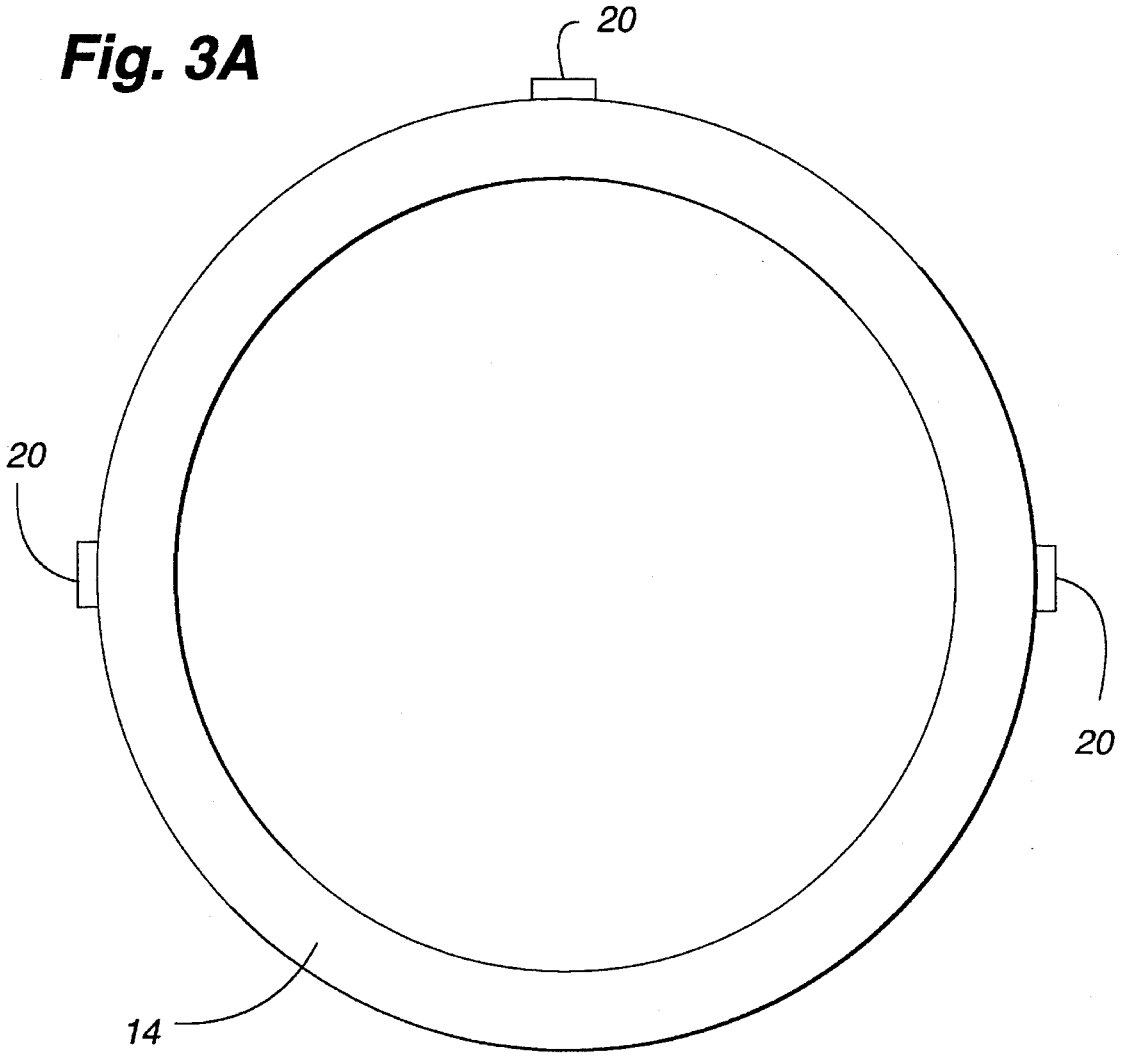
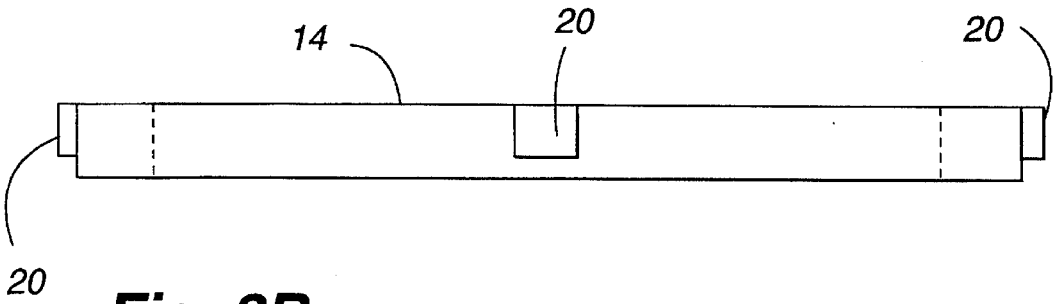
Fig. 3B

DRUM MUFFLING AND MICROPHONE SUSPENSION ASSEMBLY

BACKGROUND OF THE INVENTION

This invention relates to a self supporting Muffling/Microphone suspension assembly which allows for the unimpeded performance of the drum without any required alterations to the drum, or its' working parts, while still maintaining correct muffling of overtones or harmonics, and optimum microphone response.

SUMMARY OF THE INVENTION

In accordance with this invention an internal drum muffling/microphone suspension assembly is provided. The assembly is custom fit to mount inside of a drum and adjust to muffle overtones and harmonics, while also properly suspending a microphone for optimum response. The assembly consists of 2 trays, 2 mufflers, 6 spokes, 6 spring attachments, and 1 microphone holder. The trays and microphone holder are made from resin in injection molds. The mufflers are made of common foam rubber. The spokes are aluminum dowels, and the springs are various sizes and thicknesses of coil springs.

The great advantage of the assembly is that it is designed to interfere minimally with the proper operation and resonance of the involved drum. Also, the microphone suspension system does not have to be employed to gain the use and benefits of the muffling assembly, but microphone suspension can not be employed without the muffling assembly in place.

FIG. 1A is a top view of the muffler tray in proportion.

FIG. 1B is a side view of the muffler tray in FIG. 1A.

FIG. 3A is a top view of a muffler matched to the trays on which the muffler rests.

FIG. 3B is a side view of the muffler in FIG. 3A.

DETAILED DESCRIPTION

The tray 10 in FIGS. 1A and 1B is designed to support the muffler. It's shown here in two views, top (FIG. 1A) and side (FIG. 1B). The side view shows a cut away at the bottom right, illustrating the threaded spoke holes 12. The actual size of the tray is not important since it will be custom fit to mount in any size drum. But the proportions relative to the muffler 14 (FIG. 3A) are extremely important so as to provide proper seating for the muffler. (FIGS. 1A and 3A can be superimposed over each other to show seating of muffler in the tray.)

Figure 2:
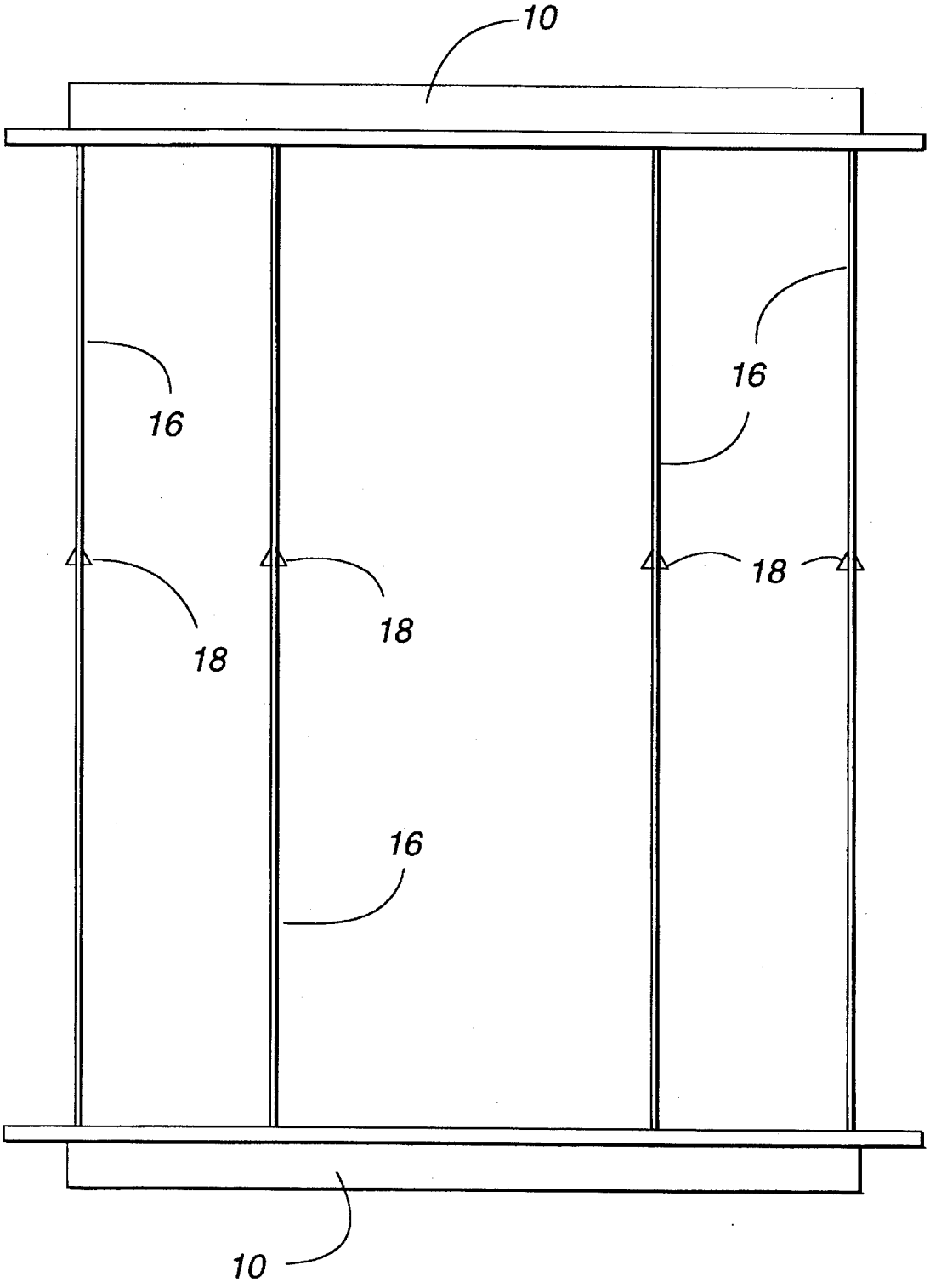
FIG. 2 shows the preferred embodiment of the invention with two muffler trays assembled with spokes.

In FIG. 2 the trays are assembled with spokes. Again the actual size is not important since the length of the spokes 16 and size of the trays will vary. However, 0.125" diameter spokes will work for any size configuration. An important factor here is the threading of the spokes in opposition by schematically shown turnbuckles 18. When the spokes or the turnbuckles are rotated one direction, the trays will push apart. When the spokes or the turnbuckles are rotated the other direction, the trays will pull together. This allows for varying tension of the muffler against the skin of the drum thereby decreasing certain harmonics and overtones as specified by the user.

The muffler 14 in FIGS. 3A and 3B is matched to fit on the tray in FIGS. 1A and 1B. Here also only the proportions are important, not the actual size of the muffler 14. The nodes 20 sticking out on three sides of the muffler are to insure centering equidistant from the shell of the drum. FIGS. 3A and 1A can be superimposed to show correct seating of muffler 14 on tray 10.

Figure 4:
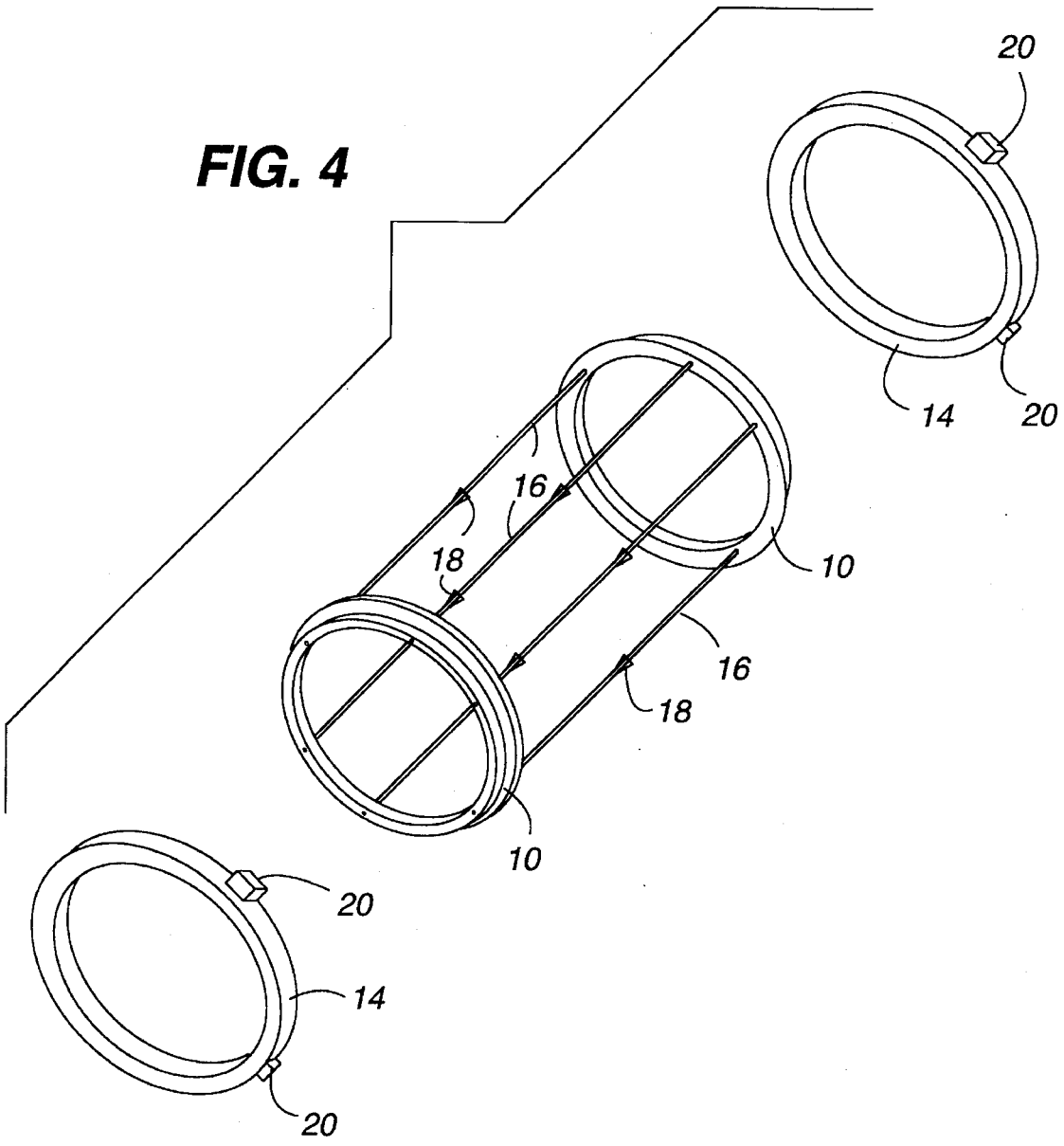
FIG. 4 is an exploded view assembly showing all parts of the preferred embodiment of the invention except for the microphone suspension.
Figure 5:
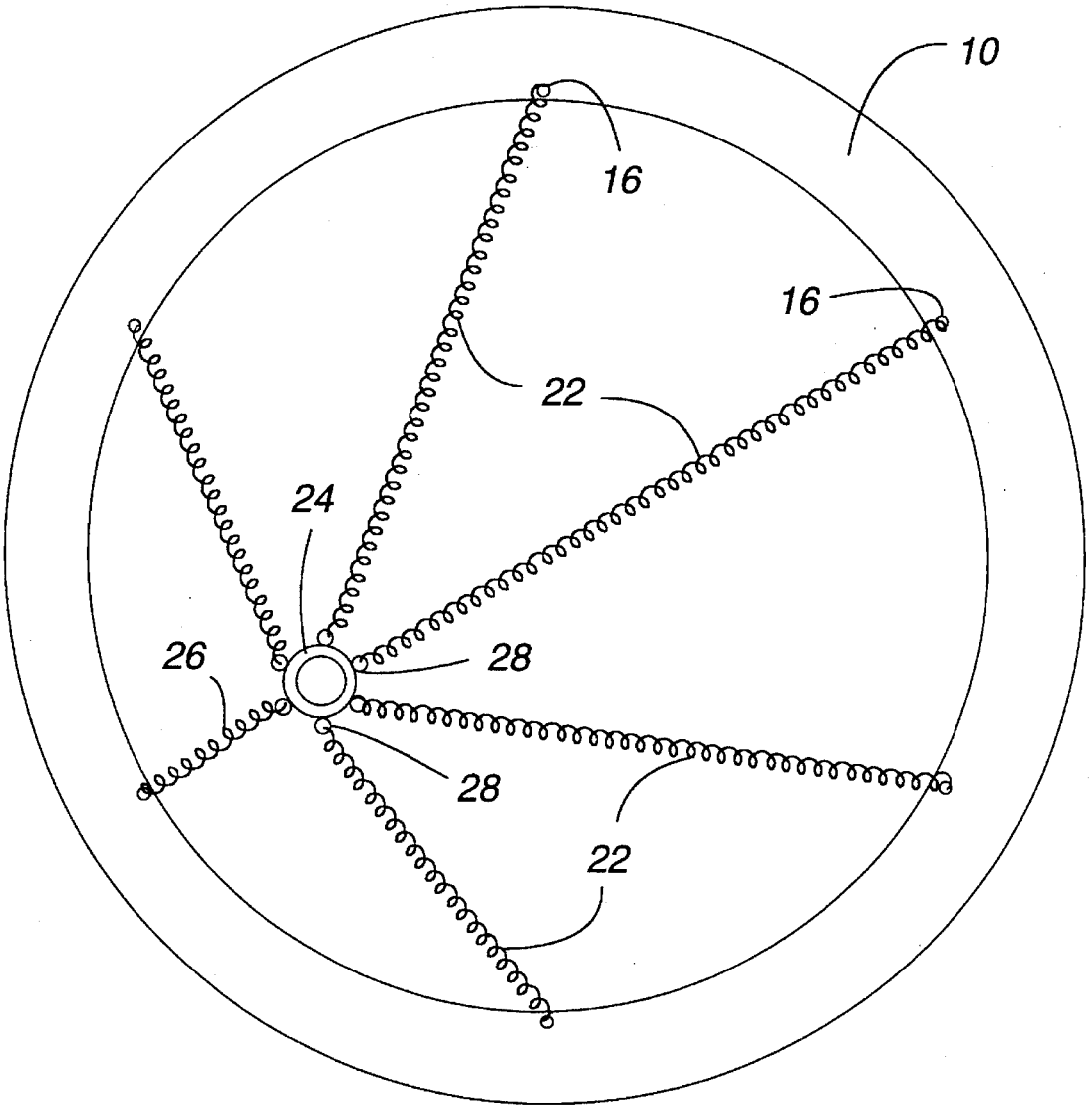
FIG. 5 shows the microphone suspension attached to the spokes.
Figure 6:
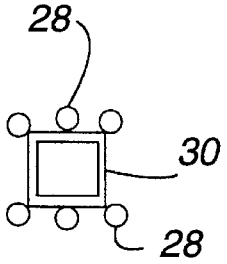
FIG. 6 shows an alternate microphone holder.

FIG. 4 is an exploded assembly view of the entire muffler assembly, minus the microphone suspension fittings. Common elements in FIGS. 1–5 have been given the same reference numerals. The microphone suspension as mounted in the muffler assembly is shown in FIG. 5. All aspects of the suspension fittings are variable to compensate for the different types and weights of microphones used in recording and amplification. Different weight and length springs 22, and different microphone holders 24, are needed to complement the wide variety of microphones on the market today. In FIG. 5, shorter spring 26, is used on one side of a standard cylindrical microphone holder to offset the holder from center, as used in some recording applications. But all microphone holders in this system, regardless of shape, are equipped with six rings 28, in which to attach the springs. An alternate shaped microphone holder 30 is also shown in FIG. 6.

I claim:

1. A drum muffling assembly for muffling the harmonics and overtones in a drum having a shell, a first skin on one end of the drum and a second skin on the opposite end of the drum, said assembly comprising:

a first muffler for muffling the drum when pressed against the first skin of the drum;

a second muffler for muffling the drum when pressed against the second skin of the drum;

a first tray for supporting the first muffler;

a second tray for supporting the second muffler;

spokes connected between the first tray and the second tray for moving the trays with respect to one another;

said spokes being oppositely screw threaded into each tray and rotatable in a first direction to push the first and second mufflers further apart, moving the first muffler against the first skin and the second muffler against the second skin to increase tension in the skins of the drum, and rotatable in a second direction to move the first and second mufflers closer together to decrease tension in the skins of the drum.

2. A drum muffling assembly for muffling the harmonics and overtones in a drum having a shell, a first skin on one end of the drum and a second skin on the opposite end of the drum, said assembly comprising:

a first muffler for muffling the drum when pressed against the first skin of the drum;

a second muffler for muffling the drum when pressed against the second skin of the drum;

a first tray for supporting the first muffler;

a second tray for supporting the second muffler;

spokes connected between the first tray and the second tray; and turnbuckles mounted on the spokes rotatable in a first direction to move the first and second mufflers further apart to increase tension in the skins of the drum and rotatable in a second direction to pull the first and second mufflers closer together to decrease tension in the skins of the drum.

3. A drum muffling assembly for muffling the harmonics and overtones in a drum having a shell, a first skin on one end of the drum and a second skin on the opposite end of the drum, said assembly comprising:

a first muffler for muffling the drum when pressed against the first skin of the drum;

a second muffler for muffling the drum when pressed against the second skin of the drum;

a first tray for supporting the first muffler;

a second tray for supporting the second muffler;

spokes connected between the first tray and the second tray for moving the trays far enough apart to apply tension to the skins of the drum by pressing the first muffler against the first skin and the second muffler against the second skin;

a microphone holder for holding a microphone inside the drum; and a plurality of springs mounted between said holder and a plurality of said spokes for suspending said holder inside the drum.

4. The muffling assembly of claim 3 wherein:

said springs are of different lengths for mounting said holder at different positions inside the drum.

* * * * *